US009400156B2

(12) United States Patent
Lamb

(10) Patent No.: US 9,400,156 B2
(45) Date of Patent: Jul. 26, 2016

(54) STORAGE COMPARTMENT

(71) Applicant: Ronald Michael Lamb, Dallas, TX (US)

(72) Inventor: Ronald Michael Lamb, Dallas, TX (US)

(73) Assignee: Ronald Michael Lamb, Dallas, TX (US)

( * ) Notice: Subject to any disclaimer, the term of this patent is extended or adjusted under 35 U.S.C. 154(b) by 0 days.

(21) Appl. No.: 14/874,815

(22) Filed: Oct. 5, 2015

(65) Prior Publication Data

US 2016/0097613 A1 Apr. 7, 2016

Related U.S. Application Data

(60) Provisional application No. 62/059,645, filed on Oct. 3, 2014.

(51) Int. Cl.
*F41C 23/22* (2006.01)

(52) U.S. Cl.
CPC ..... *F41C 23/22* (2013.01)

(58) Field of Classification Search
CPC ..... F41C 23/22
USPC ..... 42/71.01, 72, 73, 74
See application file for complete search history.

(56) References Cited

U.S. PATENT DOCUMENTS

| | | | | | |
|---|---|---|---|---|---|
| 3,618,248 | A * | 11/1971 | Into | F41C 23/22 | 42/71.01 |
| 7,762,018 | B1 * | 7/2010 | Fitzpatrick | F41A 11/02 | 42/73 |
| 9,109,855 | B1 * | 8/2015 | Kincel | F41C 23/20 | |
| 2006/0010749 | A1 * | 1/2006 | Kincel | F41C 23/22 | 42/71.01 |
| 2007/0261284 | A1 * | 11/2007 | Keng | F41C 23/04 | 42/73 |
| 2010/0205846 | A1 * | 8/2010 | Fitzpatrick | F41A 11/02 | 42/73 |
| 2012/0174456 | A1 * | 7/2012 | DePierro | F41C 23/22 | 42/71.01 |
| 2013/0305579 | A1 * | 11/2013 | Ward | F41C 23/22 | 42/71.01 |
| 2014/0068990 | A1 * | 3/2014 | Cabahug | F41C 23/22 | 42/84 |
| 2015/0338187 | A1 * | 11/2015 | Priddy | F41C 23/22 | 42/71.01 |

* cited by examiner

*Primary Examiner* — Bret Hayes

(57) ABSTRACT

A storage compartment having a bracket portion being configured to join with a buffer tube portion of a firearm. The bracket portion may form a generally tubular shape that conforms to the shape of the buffer tube portion. The bracket portion may further include a top side section that is disposed towards the top region of the firearm buffer tube implement, and an open ended bottom side section that extend the full length of the bracket portion along the bottom region of the firearm buffer tube implement. The open ended bottom side section provides passage for the item to be stored. The open ended bottom side section terminates at a pair of flanges. The storage compartment may include, without limitation, a container, holder, repository, receptacle, housing, case, vessel, canister, and cover.

20 Claims, 5 Drawing Sheets

STORAGE COMPARTMENT

CROSS-REFERENCE TO RELATED APPLICATIONS

The present Utility patent application claims priority benefit of the [U.S. provisional application for patent Ser. No. 62/059,645 entitled "PISTOL MOUNTED STORAGE DEVICE", filed on 3 Oct. 2014 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to a storage compartment. More particularly, the invention relates to a storage compartment that joins with a buffer tube portion of a firearm for storing various items to the firearm.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that Typically, a conventional firearm includes an elongated buffer tube, to which the barrel and firing mechanism are attached. The buffer tube may provide a means for the shooter to support the device and easily aim it.

Generally, recoil from a firearm, i.e., "kick", is the backward momentum generated by a firearm when it is discharged. High-powered cartridges and/or rounds with greater mass produce significantly more recoil energy than low-powered cartridges and/or rounds with less mass. The momentum generated by discharging a firearm is transferred to the ground through the body of the shooter and perceived and/or felt by the shooter as recoil.

It is known that a buffer tube assembly is a mechanism that attaches to a pistol at the rear of the pistol receiver and comprises a tube containing a spring with a plunger-like device (i.e., a buffer) positioned at the end of the spring nearest the receiver or action. The buffer tube houses the buffer spring and buffer. Upon discharge, the pistol bolt travels rearward from the receiver, contacts the buffer and drives the buffer back into the buffer tube, compressing the buffer spring.

It is known that operators of firearms require firearm related items while operating or carrying the firearm. These items may include extra magazines, cleaning supplies, medical supplies, shooting equipment, medicine, compasses, and general supplies pertinent to the firearm or firearm activities. These are items that the operator may want fast easy access to.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
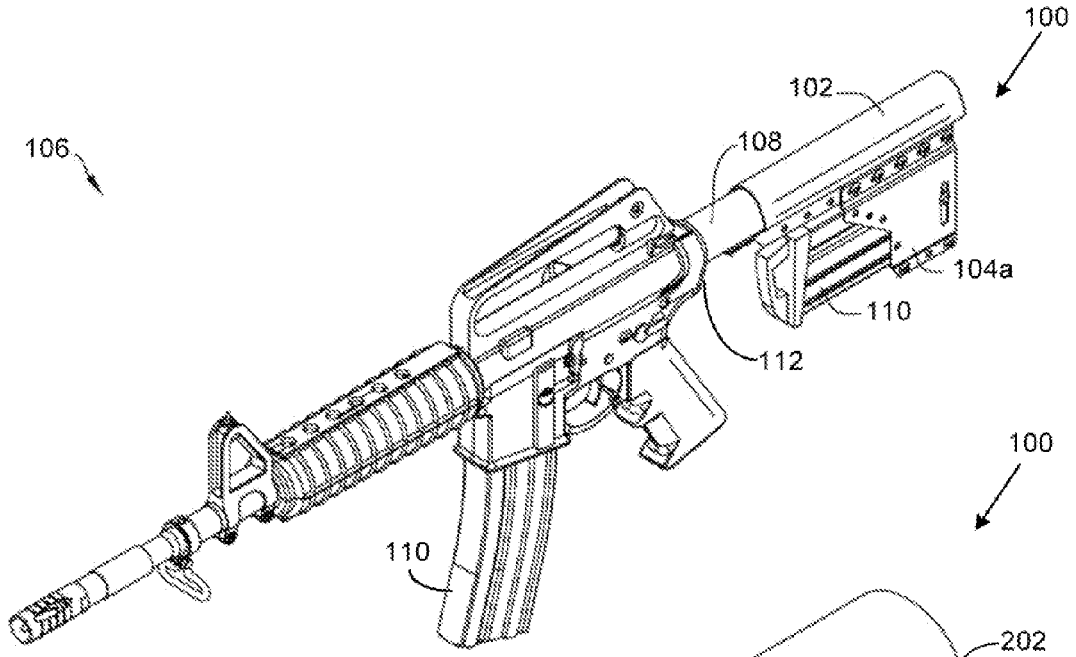
FIG. 1 illustrates a perspective view of an exemplary storage compartment joined with an exemplary firearm, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. July 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v.

Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. §112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware--for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

There are various types of storage compartments for firearms that may be provided by preferred embodiments of the present invention. In one embodiment of the present invention, a buffer tube implement of the firearm comprises a buffer tube portion. A storage compartment is configured to join with the buffer tube portion of the firearm for storing at least one firearm related item. The compartment has a generally elongated cylindrical shape that joins with the buffer tube portion and the storage compartment that provides a large surface area for storing and supporting at least one item directly from the firearm. The storage compartment is effective in that it joins with a component of the firearm that is within easy reach while operating the firearm.

As discussed above, the storage compartment may join with a buffer tube portion on the firearm. In one embodiment, the buffer tube implement may include various lengths. The buffer tube may also be used to allow attachment of the storage compartment to the firearm, by way of a receiver extension of the firearm. The storage compartment may include, without limitation, a container, holder, repository, receptacle, housing, case, vessel, canister, and cover.

The storage compartment, which is configured to have substantially the same length as the buffer tube implement, may be bolted along the length of the buffer tube portion. This disposition of the storage compartment provides quick access to the at least one item while carrying and operating the firearm. The storage compartment may also provide a surface for receiving, but not limited to, additional magazine of the firearm, cleaning supplies, medical supplies, shooting equipments, and shooting supplies. In addition, the storage compartment may also provide, but not limited to, a stable support for the firearm, a buffer tube cover, a shooter's aid, and a brace. Further, the storage compartment may be bolted to the buffer tube portion of a buffer tube equipped pistol.

In some embodiments, the storage compartment may include a bracket portion configured to receive the buffer tube portion for mounting, and also configured for containing or supporting at least one item. The bracket portion may form a generally tubular shape that conforms to the shape of the buffer tube portion. The bracket portion comprises a rearward end disposed towards the rear of the firearm, and a forward end disposed towards the front of the firearm. An end cap may terminate the open region of the rearward end of the bracket portion.

In some embodiments, the bracket portion may further include a top side section that is disposed towards the top region of the firearm buffer tube implement, and an open ended bottom side section that extend the full length of the bracket portion along the bottom region of the firearm buffer tube implement. The open ended bottom side section provides passage for the item to be stored. The open ended bottom side section terminates at a pair of flanges. The flanges may include a plurality of bracket apertures disposed in a spaced-apart relationship along the length of the flanges.

In some embodiments, an elongated panel may extend along the open ended bottom side, terminating at the end cap. The elongated panel may at least partially cover the open ended side. The elongated panel may slide in and out of the bracket portion. The elongated panel may include a plurality of panel apertures disposed in a spaced-apart relationship along the length of the elongated panel, and in alignment with the bracket apertures. At least one bracket fastener may pass through the panel apertures and the bracket apertures to fasten the open ended side around the buffer tube portion. In one embodiment, a cable is weaved through the bracket apertures and the panel apertures for tethering the item to the storage compartment.

In some embodiments, a pair of side plates clamp on the sides of the bracket portion to help maintain the bracket portion in alignment with the buffer tube portion of the firearm. The pair of side plates comprise of a left wall and a right wall and may include a generally flat plate having beveled edges that ride the contour of the bracket portion. The pair of side plates rely on various fasteners passing through various apertures in the side plates to securely press against the bracket portion. A buffer tube cover may be employed to prevent the bracket portion from sliding around the buffer tube. The buffer tube cover may comprise of, but not limited to, rubber, silicon, and any non-lip material. The buffer tube cover may further comprise of durable, washable, and non-absorbent material. In an embodiment, the buffer tube cover may be incorporated with the bracket portion. The cover may be disposed on an inner portion of the bracket portion. In another embodiment, the cover may be placed over the buffer tube before the bracket portion is joined with the buffer tube implement.

In one embodiment, a plurality of side plate securement slots and a plurality of side plate clamp holes enable passage of at least one plate fastener for fastening the side plates to the bracket portion. The difference between the securement slots and the clamp holes being that the slots are disposed at the top side of the firearm, and the clamp holes are configured to match the size of the bracket apertures and panel apertures at the open ended side of the bracket portion, such that alignment is possible. In some embodiments, a side plate rear slot extends vertically through the side plates. The side plate rear slot is configured to enable passage of an adjustment fastener to adjust the side plates in relation to the bracket portion. This may be useful for disassembling the storage compartment, or when the temperature of the firearm expands the metal composition of the storage compartment; thereby requiring the side plates and/or the bracket to be adjusted.

FIG. 1 illustrates a perspective view of an exemplary storage compartment joined with an exemplary firearm, in accordance with an embodiment of the present invention. In one aspect, a storage compartment 100 is configured to join with a buffer tube implement 108 of a firearm 106 receiver extension for storing at least one item or firearm related item. For example, the item may include a magazine portion 110 or an extra magazine portion that is easily accessible from the storage compartment while operating the firearm.

In some embodiments, the storage compartment may form a generally elongated cylindrical shape that provides a large surface area for storing the at least one item, or hanging the item directly from the firearm. The storage compartment is effective in that it joins with a component of the firearm that is within easy reach while operating the firearm.

Those skilled in the art will recognize that a major area of concern for gun enthusiasts is having quick access to a secondary weapon or extra storage space on buffer tube equipped pistols. As such, the storage compartment, by means of the buffer tube implement, may join with a firearm, such as an AR style pistol. Nonetheless, the firearm may include an AR-15 pistol fitted with a buffer tube. Though in other embodiments, the firearm may include, without limitation, an Armalite (AR) style pistol, a semi-automatic pistol, an automatic pistol, and any buffer tube equipped pistols where the buffer tube serves a vital function in the operation of the pistol but not implemented as a shoulder stock. And, the firearm my not include a rifle.

As discussed above, the storage compartment may join with a buffer tube portion on the firearm. In one embodiment, the buffer tube portion may include a non-slip buffer tube jacket. Those skilled in the art will recognize that a buffer tube may also be used to allow attachment of, but not limited to, a holder, container, receptacle, case, casing, cover, housing, vessel, canister, and repository, to the firearm.

The storage compartment, which has substantially the same length as the buffer tube portion, may be bolted along the length of the buffer tube portion. This disposition of the storage compartment provides quick access to the at least one item while carrying and operating the firearm. The storage compartment may also provide a surface for receiving additional magazine of the firearm. Suitable materials for the storage compartment may include, without limitation, steel, aluminum, metal alloys, a rigid polymer, and a vacuum formed plastic. Other items that may be stored including, without limitation, cleaning supplies, medical supplies, shooting equipments, shooting supplies.

In some embodiments, the storage compartment may include a bracket portion 102 configured to receive the buffer tube portion for mounting, and also configured for containing or supporting the at least one item. In one possible embodiment, the buffer tube may be sequentially disposed to a receiver 112 of the firearm. In another embodiment, the bracket portion may be sequentially disposed to a buffer tube portion over a jacket/cover 113 to help prevent the bracket portion from sliding around or out of the buffer tube portion and protect the buffer tube portion from scratches. However, the bracket portion chiefly mounts to the buffer tube portion, as described below. In some embodiments, a pair of side plates 104*a*, 104*b* clamp against the bracket portion to secure the bracket portion against the buffer tube portion of the firearm. The pair of side plates 104*a*, 104*b* comprises at least a top flange with bracket apertures used to secure the pair of side plates against the bracket portion. The pair of side plates 104*a*, 104*b* further comprises a bottom flange with apertures configured to join the pair of side plates together.

Figure 2:
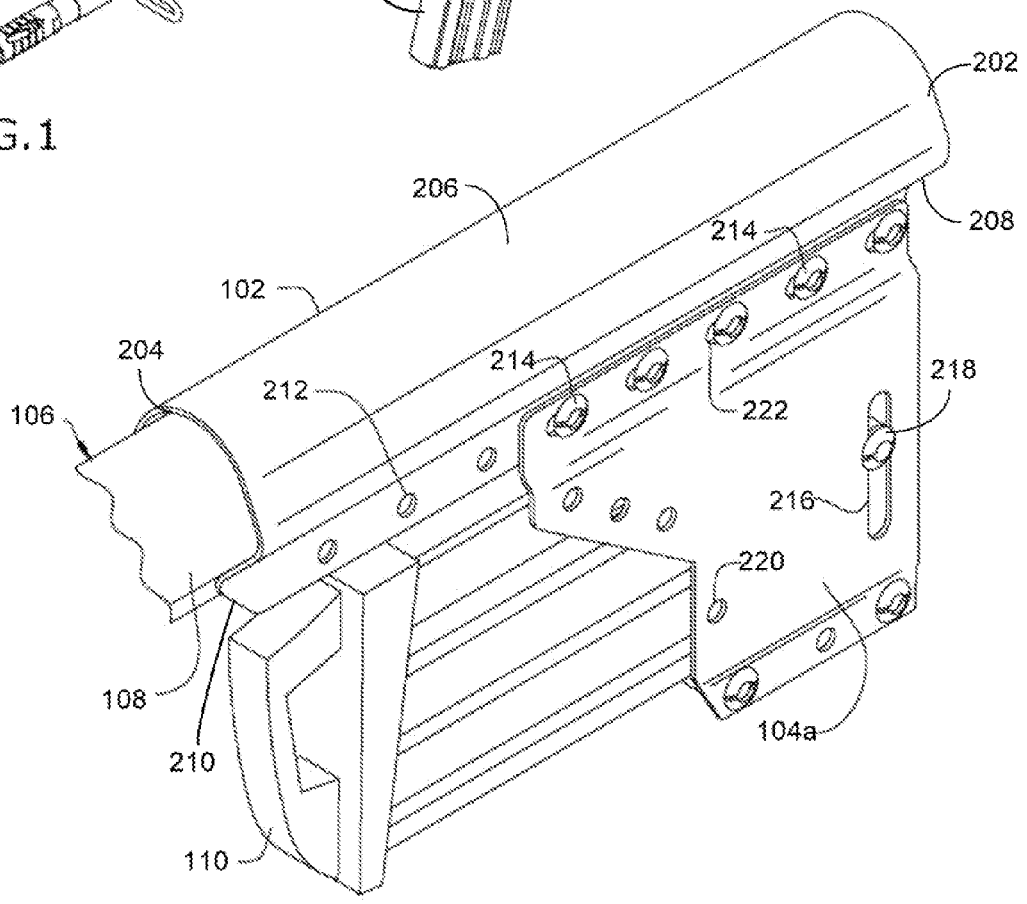
FIG. 2 illustrates a top angle close up view of an exemplary storage compartment storing an exemplary magazine portion of a firearm, in accordance with an embodiment of the present invention.

FIG. 2 illustrates a top angle close up view of an exemplary storage compartment storing an exemplary magazine portion of a firearm, in accordance with an embodiment of the present invention. In one aspect, the flanges have sufficient space between them to enable snug retention of a magazine portion of the firearm, as shown in FIG. 2. The at least one item for storage may include, without limitation, a magazine portion, extra magazines, cleaning supplies, medical supplies, shooting equipment, medicine, compasses, and general supplies pertinent to the firearm or firearm activities. The item may be attached in a variety of ways to the storage compartment.

As discussed above, the bracket portion may be configured to receive the buffer tube portion for mounting, and also configured for containing or supporting the at least one item. The bracket portion may form a generally tubular shape that conforms to the shape of the buffer tube portion. In an embodiment, the bracket portion includes a buffer tube jacket/cover for firmer grip and help prevent the bracket portion from sliding around or out of the buffer tube. The bracket portion comprises a rearward end 202 disposed towards the rear of the firearm, and a forward end 204 disposed towards the front of the forearm. An end cap may terminate the open region of the rearward end of the bracket portion.

In some embodiments, the bracket portion may further include an elongated top side 206 that is disposed towards the top region of the firearm buffer tube, and an open ended bottom side 208 that extend the full length of the bracket portion along the bottom region of the firearm buffer tube. The open ended bottom side may provide a passage for the item to be stored. The open ended bottom side terminates at a pair of flanges 210. The flanges may include a plurality of bracket apertures 212 disposed in a spaced-apart relationship along the length of the flanges. At least one bracket aperture 214 is configured to clamp the bracket portion securely to the buffer tube portion and hold the pair of side plates 104*a*, 104*b* against the bracket portion, thereby, securing the storage compartment with the buffer tube portion of the firearm. A non-slip material may be incorporated to the full length of the open bottom side of the bracket portion, to prevent the bracket portion from sliding around the buffer tube. The non-slip material may comprise of, but not limited to, rubber, plastic, silicon, and any non-slip material.

In some embodiments, an elongated panel may extend along the open ended bottom side of the bracket portion, terminating at the end cap. The elongated panel may at least partially cover the open ended side. The elongated panel may slide in and out of the bracket portion. In one embodiment, a cable may be weaved through the bracket apertures and the panel apertures for tethering the item to the storage compartment.

In some embodiments, the pair of side plates clamp on the sides of the bracket portion to help maintain the bracket portion in alignment with the buffer tube portion of the firearm. The pair of side plates may form a generally flat plate having beveled edges that ride the contour of the bracket portion. The pair of side plates rely on various fasteners passing through various apertures in the side plates to securely press against the bracket portion.

In one embodiment, a plurality of side plate securement slots 222 and a plurality of side plate clamp holes 220 enable passage of the at least one bracket fastener for fastening the side plates to the bracket portion. At least one grommet 224 may connect each side plate and form a channel for the bracket fastener to pass through. The difference between the securement slots and the clamp holes being that the slots are disposed at the top side of the firearm, and the clamp holes are configured to match the size of the bracket apertures and panel apertures at the open ended side of the bracket portion. In this manner, alignment of the various slots and apertures is possible.

In some embodiments, a side plate rear slot 216 extends vertically through the side plates. The side plate rear slot is configured to enable passage of a plate adjustment fastener 218 to adjust the side plates in relation to the bracket portion. This may be useful for disassembling the storage compartment, or when the temperature of the firearm expands the metal composition of the storage compartment; thereby requiring the side plates and/or the bracket to be adjusted. A clip with handle 115 holds the stored magazine portion in place and provides support to the stored magazine portion.

Figure 3:
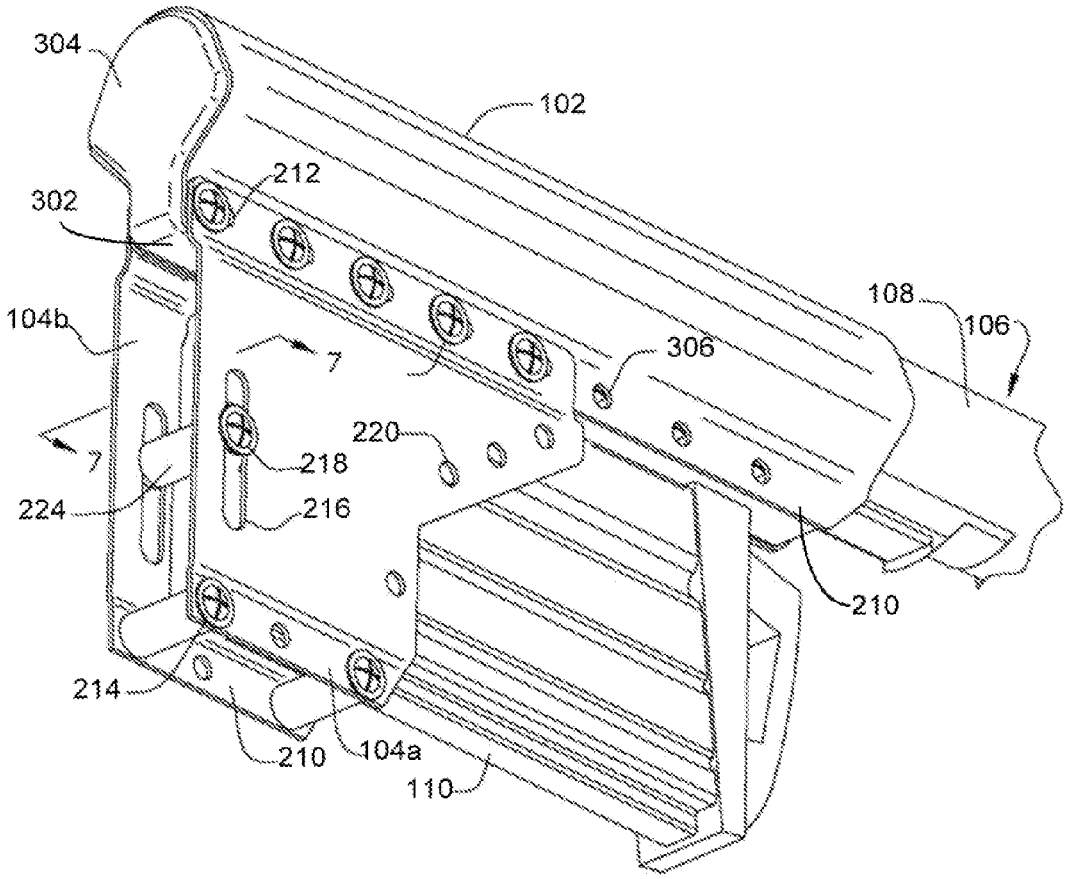
FIG. 3 illustrates a bottom angle close up view of an exemplary storage compartment storing an exemplary magazine portion of a firearm, in accordance with an embodiment of the present invention.

FIG. 3 illustrates a bottom angle close up view of an exemplary storage compartment storing an exemplary magazine portion of a firearm, in accordance with an embodiment of the present invention. In one aspect, an elongated panel 302 may extend along the open ended bottom side of the bracket portion, terminating at an end cap 304. The elongated panel may at least partially cover the open ended side. The elongated panel may slide in and out of the bracket portion. The elongated panel may include a plurality of panel apertures 306 disposed in a spaced-apart relationship along the length of the elongated panel, and in alignment with the bracket apertures. At least one bracket fastener may pass through the panel apertures and the bracket apertures to fasten the open ended side around the buffer tube portion. In one embodiment, a cable is weaved through the bracket apertures and the panel apertures for tethering the item to the storage compartment. In other embodiments, the pair of side plates 104*a*, 104*b*, each comprises an upper flange region with the plurality of side plate securement slots 222 being configured to enable passage of the at least one bracket fastener for fastening each of the side plates to the bracket portion. Each of the pair of side plates 104*a*, 104*b* further comprises a lower flange region with plurality of side plate clamp holes 220 being configured to join bottom regions of each of the pair of side plates. The clamp holes are configured to match the size of the bracket apertures and panel apertures at the open ended side of the bracket portion. The at least one grommet 224 may connect the lower flange regions of each side plate and form a channel for the at least one item to be stored. In some embodiments, a side plate rear slot 216 extends vertically through each of the side plates. The side plate rear slot 216 is configured to enable passage of a plate adjustment fastener 218 to adjust the side plates in relation to the bracket portion. This may be useful for disassembling the storage compartment, or when the temperature of the firearm expands the metal composition of the storage compartment, thereby, requiring the side plates and/or the bracket to be adjusted.

Figure 4:
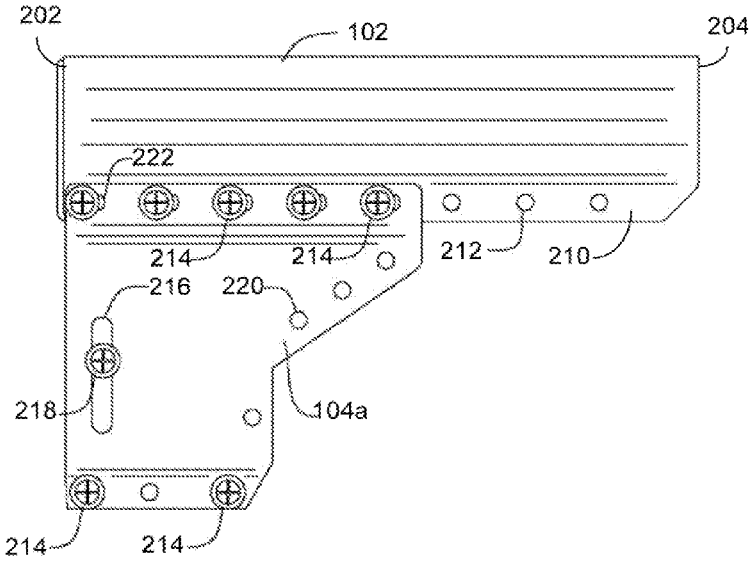
FIG. 4 illustrates an elevated side view of an exemplary storage compartment, in accordance with an embodiment of the present invention.

FIG. 4 illustrates an elevated side view of an exemplary storage compartment, in accordance with an embodiment of the present invention. In an embodiment, the storage compartment is configured to mate with a firearm. In another embodiment, the storage compartment is, but not limited to, a holder, container, receptacle, case, casing, cover, housing, vessel, canister, and repository. Specifically, the bracket portion cradles the buffer tube or other buffering mechanism that is integrated into the firearm. FIG. 4 shows the symmetrical design that mates with the firearm. The firearm may include an AR-15 pistol fitted with a buffer tube. Though in other embodiments, the firearm may include, without limitation, an Armalite (AR) style pistol, a semi-automatic pistol, an automatic pistol, and any firearm equipped with a buffer tube, such that a buffer tube serves an essential function in the operation of the pistol, but not as a shoulder stock.

Figure 5:
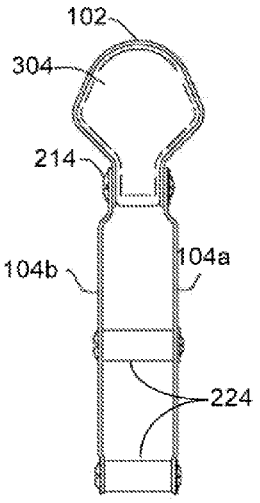
FIG. 5 illustrates a top view of an exemplary storage compartment, in accordance with an embodiment of the present invention.

FIG. 5 illustrates a top view of an exemplary storage compartment, in accordance with an embodiment of the present invention. In one aspect, the bracket portion cradles the buffer tube portion, forming a snug fit that is further tightened through at least one bracket fastener. In some embodiments, the storage compartment may be fabricated from rubber, injection molded rubber, or plastic.

Figure 6:
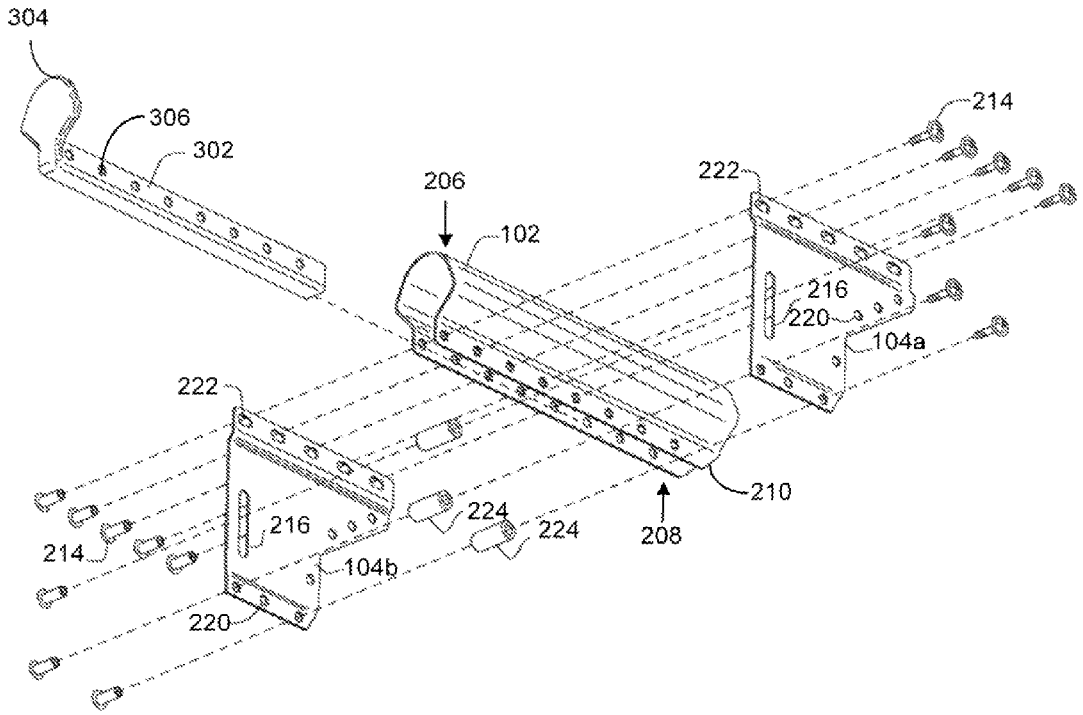
FIG. 6 illustrates a blow up view of an exemplary storage compartment, in accordance with an embodiment of the present invention.

FIG. 6 illustrates a blow up view of an exemplary storage compartment, in accordance with an embodiment of the present invention. In one embodiment, the bracket fastener that secures the bracket portion to the buffer tube portion of the firearm may include, without limitation, a Chicago screw, a bolt, and a magnet. Though in some embodiments, the bracket portion is integrated into the buffer tube portion.

Figure 7:
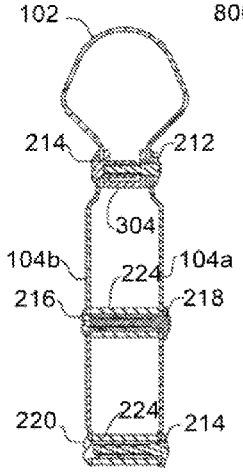
FIG. 7 illustrates a sectioned side view of an exemplary storage compartment, the section taken along section 7--7 of FIG. 3, detailing tan exemplary bracket portion, in accordance with an embodiment of the present invention.

FIG. 7 illustrates a sectioned side view of an exemplary storage compartment, the section taken along section 7-7 of FIG. 3, detailing an exemplary bracket portion, in accordance with an embodiment of the present invention. In one aspect, the at least one item is stored securely inside the cavity of the bracket portion by the elongated panel and the clamping force of the fasteners and the side plates. In one embodiment, the bracket fastener may hold the flanges together to contain the item therein. Further, a clip may be used to contain the item in the cavity of the bracket portion. The side plates also work to clamp down on the bracket portion. This is especially useful because the recoil from the firearm may loosen the bracket fasteners, and the secondary fastening capacity of the side plates reinforce the attachment to the buffer tube portion.

Figure 8:
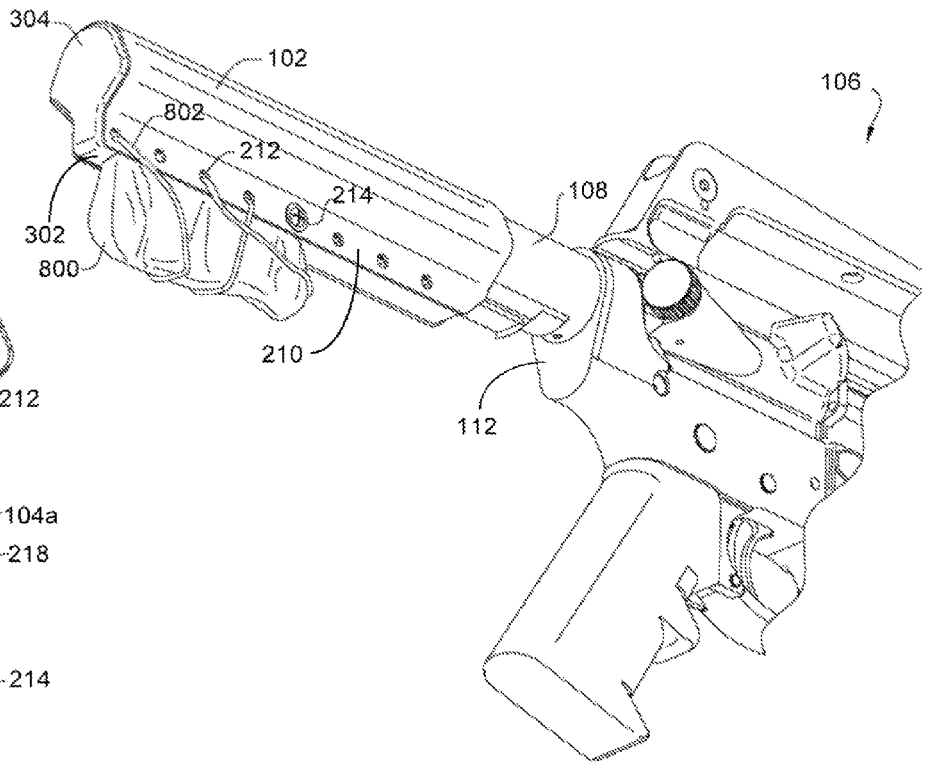
FIG. 8 illustrates a perspective view of an exemplary storage compartment securing at least one item, in accordance with an embodiment of the present invention.

FIG. 8 illustrates a perspective view of an exemplary storage compartment securing at least one item, in accordance with an embodiment of the present invention. In one aspect, the at least one item 800 may be retained inside the cavity of the bracket portion, or supported by the flanges of the bracket portion. As illustrated in FIG. 8, a cable 802 may be weaved through the bracket apertures to tether the item to the bracket portion.

In conclusion, the storage container may be configured to join with a buffer tube portion of a firearm for storing at least one firearm related item. The storage container includes a bracket portion having a generally elongated cylindrical shape that provides a large surface area for storing and supporting the at least one item directly from the firearm. A pair of plates along with various fasteners secure the bracket portion to the buffer tube portion of the firearm. The storage compartment is effective in that it joins with a buffer tube of the firearm that serves an essential function in the operation of the firearm with a capacity for additional usages.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a storage container that joins with a buffer tube portion of a firearm for storing at least one firearm related item according to the present invention will be apparent to those skilled in the art. Various aspects of the invention have been described above by way of illustration, and the specific embodiments disclosed are not intended to limit the invention to the particular forms disclosed. The particular implementation of the storage container that joins with a buffer tube portion of a firearm for storing at least one firearm related item may vary depending upon the particular context or application. By way of example, and not limitation, the storage container that joins with a buffer tube portion of a firearm for storing at least one firearm related item described in the AR-15 firearm implementations; however, similar techniques may instead be applied to all type of pistols, and any firearm that utilizes a buffer tube, in which the buffer tube serves an essential function in the operation of the pistol, but not as a shoulder stock, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

The invention claimed is:

1. A storage compartment comprising:

a bracket portion configured to join to a buffer tube portion of a firearm, said bracket portion comprising;

an elongated top side component, said elongated top side component configured to join to said buffer tube portion of said firearm;

an open ended bottom side component, said open ended bottom side component comprises at least a pair of bracket flanges, said pair of bracket flanges being configured to clamp said bracket portion to said buffer tube portion; and a bracket fastening device, said bracket fastening device comprises at least a plurality of bracket fastening devices being configured to fasten the bracket portion to said buffer tube portion;

a housing, said housing comprises at least one of a container, holder, repository, receptacle, and cover, for storing at least one item, said housing comprising;

a first side plate, said first side plate comprises at least an upper plate flange region with a plurality of side plate securement slots being configured to enable passage of said bracket fastening device, said bracket fastening device being operable for fastening said first side plate to said bracket portion;

a second side plate, said second side plate comprises at least an upper plate flange region with a plurality of side plate securement slots being configured to enable passage of said bracket fastening device, said bracket fastening device being operable for fastening said second side plate to said bracket portion;

said first side plate and second side plate further comprises a lower plate flange region; and a grommet implement, said grommet implement comprises at least two grommets, said grommet implement is configured to bridge the lower plate flange regions of said first and second side plates, said grommet implement being further configured to form a channel for storage of said at least one item.

2. The storage compartment of claim 1, in which each of said bracket flanges comprises a bracket aperture disposed in a spaced-apart relationship along the length of each of the bracket flanges.

3. The storage compartment of claim 2, said bracket portion further comprises a bracket aperture, sad bracket aperture is configured to pass said bracket fastening device to cinch the bracket portion securely to the buffer tube portion.

4. The storage compartment of claim 1, said bracket portion further comprises a non-slip material being disposed on an open bottom side of the bracket portion, said non-slip material being configured to prevent the bracket portion from sliding around the buffer tube.

5. The storage compartment of claim 4, said non-slip material comprises at least one of rubber, plastic, silicon, and any non-slip material.

6. The storage compartment of claim 1, said bracket portion further comprises an end cap being configured to terminate an open region of a rearward end of the bracket portion.

7. The storage compartment of claim 6, said bracket portion further comprises a proximate tubular shape that conforms to the shape of the buffer tube portion.

8. The storage compartment of claim 1, said first and second side plates further comprises a side plate rear slot, said side plate rear slot comprising a lengthwise slot being configured to extend vertically through a proximate side of each of the side plates.

9. The storage compartment of claim 8, said first and second side plates further comprises a plate adjustment fastener, said plate adjustment fastener being operable to adjustably slide along a length of said side plate rear slot, wherein said plate adjustment fastener being configured to adjust the side plates in relation to the bracket portion.

10. The storage compartment of claim 9, said plate adjustment fastener comprises a third grommet and a fastener, wherein said fastener being operable to be loosened to enable said plate adjustment fastener to adjustably slide along a length of said side plate rear slot.

11. The storage compartment of claim 1, said lower plate flange region comprises at least a side plate clamp hole being configured to pass a fastener to join said grommet implement to each of said first and second side plates.

12. The storage compartment of claim 1, further comprising a clip configured to hold a stored at least one item in place.

13. The storage compartment of claim 12, said at least one item comprises at least a firearm magazine.

14. The storage compartment of claim 1, further comprising an elongated panel being configured to extend along the open ended bottom side of the bracket portion, terminating at the end cap.

15. The storage compartment of claim 14, said elongated panel comprises a cover being configured to at least partially cover an open ended side of said bracket portion.

16. The storage compartment of claim 15, said elongated panel further comprises a slidable elongated panel being configured to slide in and out of the bracket portion.

17. The storage compartment of claim 16, further comprising a cable implement, said cable implement being configured to weave through the bracket apertures for tethering the at least one item to the storage compartment.

18. A storage compartment comprising:

a bracket portion configured to join to a buffer tube portion of a firearm, said bracket portion comprising;

an elongated top side component, said elongated top side component configured to join to said buffer tube portion of said firearm;

an open ended bottom side component, said open ended bottom side component comprises at least a pair of bracket flanges, said pair of bracket flanges being configured to clamp said bracket portion to said buffer tube portion; and a bracket fastening device, said bracket fastening device comprises at least a plurality of bracket fastening devices being configured to fasten the bracket portion to said buffer tube portion;

a housing, said housing comprises at least one of a container, holder, repository, receptacle, and cover, for storing at least one item, said housing comprising;

a first side plate, said first side plate comprises at least an upper plate flange region with a plurality of side plate securement slots being configured to enable passage of said bracket fastening device, said bracket fastening device being operable for fastening said first side plate to said bracket portion;

a second side plate, said second side plate comprises at least an upper plate flange region with a plurality of side plate securement slots being configured to enable passage of said bracket fastening device, said bracket fastening device being operable for fastening said second side plate to said bracket portion;

said first side plate and second side plate further comprises a lower plate flange region;

said first and second side plates further comprises a side plate rear slot, said side plate rear slot comprising a lengthwise slot being configured to extend vertically through a proximate side of each of the side plates;

said first and second side plates further comprises a plate adjustment fastener, said plate adjustment fastener being operable to adjustably slide along a length of said side plate rear slot, wherein said plate adjustment fastener being configured to adjust the side plates in relation to the bracket portion; and a grommet implement, said grommet implement comprises at least two grommets, said grommet implement is configured to bridge the lower plate flange regions of said first and second side plates, said grommet implement being further configured to form a channel for storage of said at least one item.

19. The storage compartment of claim 18, further comprising a clip configured to hold said at least one item in place, said at least one item comprises at least a firearm magazine.

20. A storage compartment comprising:

means for joining a buffer tube portion of a firearm to said storage compartment, said buffer tube joining means comprises;

means for covering said buffer tube portion; and means for clamping said joining means to said buffer tube portion;

means for storing at least one item, said storing means comprises;

means for housing said at least one item;

means for providing a channel for said at least one item; and means for attaching said storing means to said joining means.

* * * * *